United States Patent [19]

Lesnik

[11] 3,935,698

[45] Feb. 3, 1976

[54] YARN COMBINING METHOD AND DEVICE

[75] Inventor: Jack Vender Lesnik, Levittown, Pa.

[73] Assignee: Rohm and Haas Company, Philadelphia, Pa.

[22] Filed: Jan. 2, 1975

[21] Appl. No.: 537,982

[52] U.S. Cl. ..... 57/18; 57/106; 57/160

[51] Int. Cl.[2] ..... D02G 3/36; B65H 81/08

[58] Field of Search ..... 57/3, 12, 16, 17, 18, 106, 57/160, 59, 62

[56] References Cited

UNITED STATES PATENTS

| | | | |
|---|---|---|---|
| 2,052,683 | 9/1936 | Whitehead | 57/18 |
| 3,124,924 | 3/1964 | Smith | 57/18 |
| 3,126,695 | 3/1964 | McGill | 57/18 |
| 3,146,573 | 9/1964 | Jones et al. | 57/62 |
| 3,237,391 | 3/1966 | Carruthers | 57/18 |
| 3,747,317 | 7/1973 | Willis | 57/106 |

*Primary Examiner*—John Petrakes
*Attorney, Agent, or Firm*—Patrick C. Baker

[57] ABSTRACT

A first yarn is combined with a second yarn from one or more yarn packages thereof by a device which includes a yarn holder adapted to hold first yarn wound thereon, the yarn holder having an axial passage through which the secone yarn travels, a guide at the exit end of the holder for guiding the first yarn into engagement with the second yarn as the first yarn unwinds from the holder, and a support for the holder. The support together with the yarn holder pivots about the guide so that the holder is automatically aligned with the second yarn even though the second yarn varies in its angle of delivery to the holder. The second yarn thus carries the first yarn as the first yarn is wound about the second yarn.

10 Claims, 3 Drawing Figures

YARN COMBINING METHOD AND DEVICE

BACKGROUND OF THE INVENTION

This invention relates to a device and method for combining a first yarn and a second yarn as the angle of delivery of the second yarn to the first yarn varies, and more particularly for combining a fine denier yarn with a heavier denier yarn.

It is often useful or necessary to combine a fine denier yarn with a higher denier yarn, staple or tow, as in plying and twisting operations. For example, it has been found that the build-up of static electricity in nylon carpets to uncomfortable levels can be prevented or dissipated by combining the nylon carpet yarns during manufacture of the carpet with fine denier metallic yarns, including yarns which are wholly metal and yarns which are metallized, that is, metal coated. Silvered nylon yarn is an example of such metallic yarns.

The handling of metallic or non-metallic fine yarns, especially when they are to be combined with higher denier yarns such as carpet yarns, present special problems to the carpet manufacturer. The fine yarns, lacking the weight and/or bulk of the normally heavier carpet yarns, do not readily feed or "run" through delivery tubes, eyeboards, eyelets and other portions of carpet manufacturing machinery. "Runnability" of such yarns is therefore said to be poor. Fine yarns also require careful attention to yarn package geometry and spatial relationships between the packages and delivery mechanism for combination with higher denier yarns. Special accommodation must be made for the ballooning characteristics of fine yarns and the sloughing off and tendency of such yarns to snarl when delivered from a cone-shaped package into combination with a heavier yarn. For example, in the manufacture of tufted carpets, when it is attempted to lay in the fine yarns in parallel with the heavier yarns in the yarn sheet just prior to tufting, the fine yarns cross over to adjacent yarns in the yarn sheet with consequent undesirable irregularity and even snarling of the yarn sheet.

The problem is not solved by the usual methods of combining the yarns prior to formation of the yarn sheet. Serious difficulty is experienced in maintaining an efficient contact angle between the two yarns at the point of combination since the transfer of a tail of the heavier yarn from one package to another in the magazine of yarn packages commonly utilized in such systems, prevents continuity of the combining operation. The operation has to be stopped while the package of fine yarn is reoriented to accommodate the new package of heavier yarn. Also, the yarn packages must be rearranged in the creels to provide space for ballooning of the fine yarn, thus requiring substantial and expensive modification of creels and other apparatus. Further, the angle of delivery of the yarns to each other, from any package in the system, continually changes as the yarns unwind from their holders. Considerable care must therefore be taken to avoid snagging due to "tight spots," i.e., more tightly wound yarns on the holders.

The foregoing problems are greatly compounded when the fine denier yarn is a metallic yarn. Not only does the metallic yarn tend to become fouled at undesirable points in a yarn sheet in a tufting operation as a result of static build-up in the sheet, but also there is severe binding, snarling and skinning in the eyelets and delivery tubes through which the metallic yarn passes on its way to combination with the heavier yarn in a yarn sheet. When it is attempted to combine the yarns, prior to formation of the yarn sheet, especially when using magazined coneshaped yarn holders, sloughing and snarling are even more severe. Separate delivery systems for each of the yarns to a yarn sheet or other work station has to be abandoned in favor of some other approach which will also enable the carpet manufacturer avoid substantial modification of existing apparatus.

OBJECTS AND SUMMARY

Accordingly, an object of the invention is to provide a new and improved device and method for combining a fine denier yarn with a second, heavier denier yarn whereby the above-described difficulties are overcome.

Still another object of the invention is to provide a new and improved device and method for combining a fine denier metallic yarn and a heavier denier yarn, so that the yarns need not be laid-in parallel in a yarn sheet in a tufting operation or fed separately to the yarn sheet, with the above-mentioned difficulties.

These and other objects, features and advantages of the invention will be apparent from the specification which follows.

In summary outline, the invention is based upon the discovery that by utilizing a unique yarn dispensing device, a first yarn may be carried by and wrapped around a second yarn, so that the combined yarns may be efficiently delivered to a tufting or other operation without the sloughing, snarling and need for substantial redesign of apparatus which otherwise would be encountered. The device is inserted between the magazine of second yarn packages in a creel thereof and the delivery tubes to the yarn sheet in a tufting operation or other processing station. The device includes a holder for the first or fine denier yarn pivotably mounted so that such holder will follow the angle of delivery of the second or heavier yarn from the packages of the magazine as a tail of the heavier yarn is transferred from one package to the next and as the yarn unwinds from any of the packages. The yarn holder has an axial passage through which the heavier, carrier yarn passes. The device further includes a guide at the exit end of the yarn holder for guiding the first yarn into wrapping engagement with the second, carrier, yarn. The first yarn is thus wrapped about the second yarn and the combined yarns then travel to the next station in a textile manufacturing operation, most usually through plastic tubes.

In the method of the invention, the second yarn is continuously passed through the yarn holder and the guide, the first yarn is engaged by the second yarn between the exiting of the second yarn from the yarn holder and before or as it passes through the guide, the combined yarn then passing through the guide.

As indicated, the invention eliminates snarling of a fine denier yarn in eyeboards, delivery tubes, creels or in the yarn sheet of a tufting operation and has particular application to the combination of a fine metallic yarn with a heavier, non-metallic carpet yarn. The invention may be readily incorporated into existing textile manufacturing operations without substantial modification of apparatus or processing, thereby offering a substantial economic benefit.

DETAILED DESCRIPTION

For a fuller understanding of the nature and objects of the invention, reference is made to the following description taken in conjunction with the accompanying drawing, in which.

Figure 1:
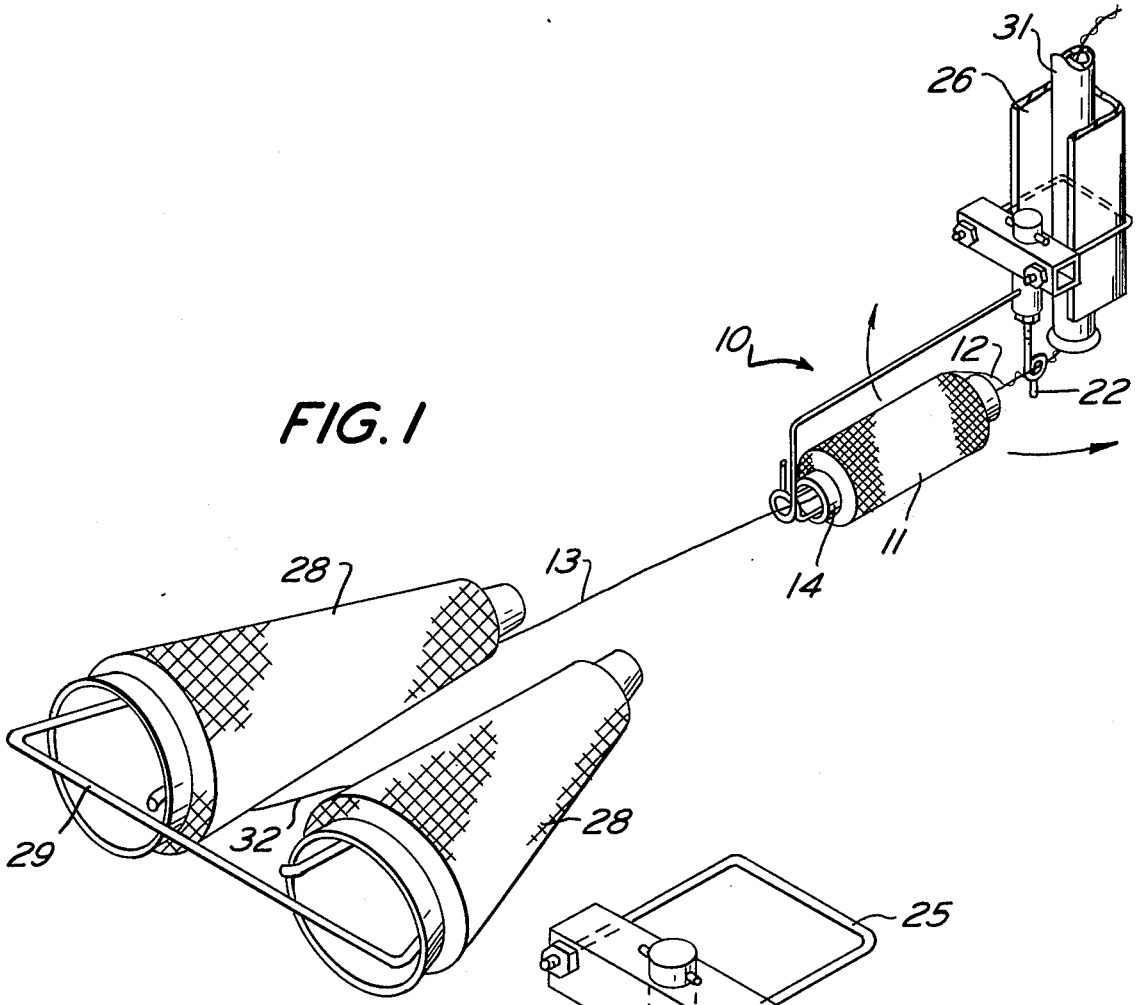
FIG. 1 is a perspective view of a yarn delivery system embodying a device and method of the invention.
Figure 2:
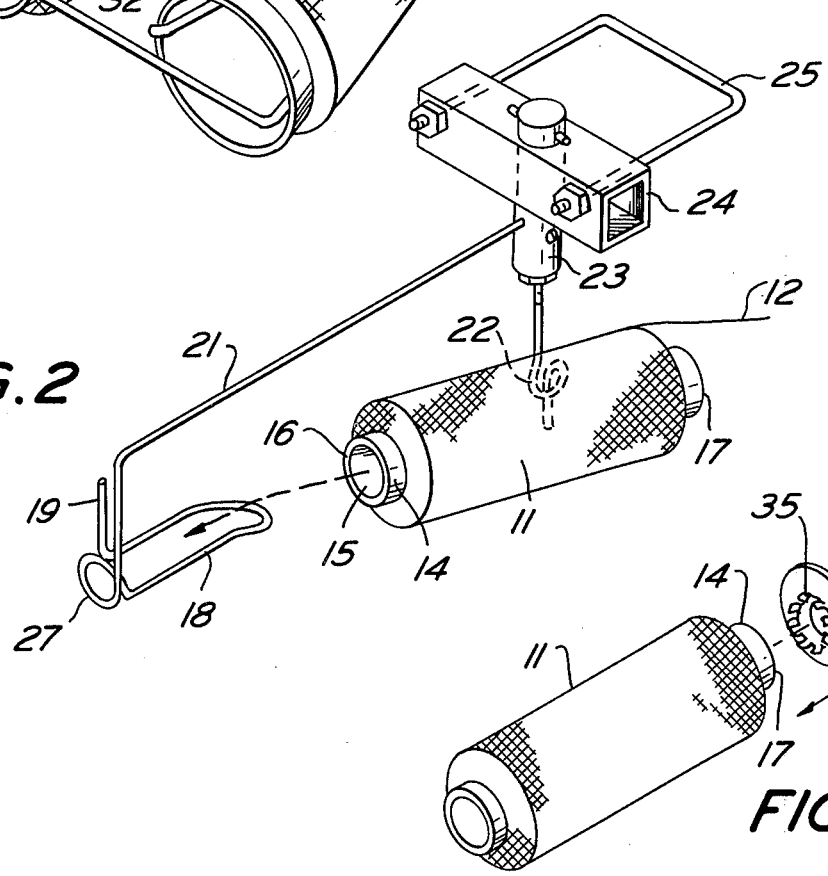
FIG. 2 is a detailed perspective view of an embodiment of the device of the invention.

With reference to the figures, a device 10 of the invention includes a package 11 of a first yarn 12. For the more specific purposes of the invention, the yarn 12 is a fine denier (about 3–30) yarn relative to a heavier denier (about 1300–2600) yarn 13 with which the fine yarn 12 is to be combined. Package 11 includes yarn holder 14 having an axial passage 15 for delivery therethrough of the second, heavier yarn 13. As shown, holder 14 and therefore package 11 is tubular but it may be in the form of a cone, if desired. The tubular form (sometimes called a "pencil" tube) reduces the tendency of the yarn 12 to slough off but, as is known, has the disadvantage of causing greater drag on the yarn as it unwinds therefrom. The greater drag sometimes induces undue tension in the yarn 12 and, therefore, undesirably tight wrapping of the yarn 12 about yarn 13. In specific cases, these tendencies can be balanced or largely eliminated, in the case of a cone by utilizing a shield or a baffle member near the cone to minimize ballooning of the yarn as it leaves the spool, or by other design of the package 11.

Holder 14 has an entry end 16 and an exit end 17 for yarn 13 and is fixedly mounted on a mandrel 18 so that it will not revolve. The mandrel may take a variety of forms, one convenient and inexpensive form, as shown, being merely a wire bent back upon itself in a U-shape in such fashion as to provide an interference fit with the interior wall of the yarn holder 14. The mandrel 18 may include a stop number 19 for yarn holder 14 in the form of an angular bend at the end of the wire adjacent the U-shaped bend. Also, as shown, the wire with which mandrel 18 and stop 19 are formed may also form a support 21 for yarn holder 14 and a yarn guide 22. Yarn guide 22 may be merely a bend in the same wire, or another piece of wire, to form a "pigtail" eyelet. The eyelet yarn guide 22 may be connected to the support wire 21 in any suitable manner, as by mounting in a columnar support number 23, the support wire 21 being mounted in the base of the member 23. The columnar member 23 swivels in a square beam 24, which beam has a U-bolt 25 therethrough, or like means for connection to a U-shaped support member 26 of a yarn delivery system. Alignment of yarn 13 for delivery through holder 14 may be facilitated in any additional way, as by passage through a second eyelet yarn guide 27. The eyelet 27 conveniently is formed as a loop in wire support 21 at a location adjacent the entry end 16 of the yarn holder. Of course, yarn holder 14 may be formed with an extension, lip or other guide means, thereby eliminating the need for any auxiliary yarn guide such as eyelet guide 27.

In a typical yarn delivery system, yarn packages such as cones 28 are mounted in a creel in magazined organization — for example, as pairs of cones 28, each pair being supported on a common bracket 29 such that the smaller diameters of the cones are angled slightly towards each other in the direction of a flexible plastic delivery tube 31 extending into the cavity of U-shaped support member 26. The first cone in each pair is connected to the second cone through a transfer tail 32, in a manner well known in the art. In the conventional delivery of a carpet yarn 13 from cones 28, travel of the yarn through tube 31 is initiated, and when the first cone 28 is depleted, the tail 32 to the second cone continues the delivery of yarn from second cone 28. The depleted cones are then periodically replaced. Since the angle of delivery of yarn 13 to delivery tube 31 will change as one cone 28 is depleted and yarn is delivered from the second cone, yarn package 11 pivots as indicated in FIG. 1. Thus, the change in delivery angle is automatically compensated for.

Figure 3:
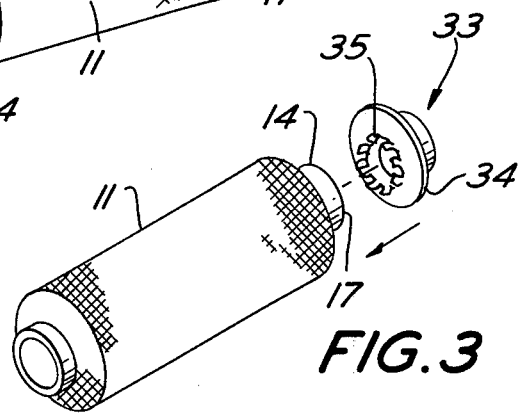
FIG. 3 is also a perspective view of another element useful with the foregoing embodiment.

When the exit end 17 of holder 14 is rough or irregular (for example, when such holders are formed of a cellulosic substance), there may be a tendency for yarn 12 to catch on the exit end 14. This can be avoided by utilizing an edge guide 33 (FIG. 3). A convenient form of edge guide is a metal or plastic disc having a rolled periphery 34 and an expandable, plug-like apertured center portion 35 which provides an interference fit with holder 14 upon insertion into the holder. Many other forms of such edge guides will be apparent, their essential feature being a diameter greater than that of holder 14 so that yarn 12 will not catch on the edge of the holder. Such edge guides may also be unitary with holder 14.

In operation, yarn 13 is continuously delivered to tube 31 through holder 14 and eyelet yarn guide 22. If the device has a yarn guide at the entry end 16 of the holder 14, such as eyelet guide 27, yarn 13 also passes through such guide. With the delivery of yarn 13 to tube 31 thus initiated, fine yarn 12 from package 11 is engaged with heavier denier yarn 13 at some point between exit end 17 and eyelet guide 22. The extent and form of engagement will vary according to the nature of yarns 12 and 13. For example, if yarn 13 is a bulked, multifilament yarn, little or no effort will be required for the engagement. On the other hand, if yarn 13 is a mono filament, some form of adhesive coating or other means for initially engaging the two yarns may be useful. In any event, moving yarn 13 picks up and carries yarn 12, yarn 12 at the same time being wrapped about yarn 13. The combined yarns then pass through eyelet guide 22 into delivery tube 31. In consequence of the lighter denier yarn 12 being carried by yarn 13, no snarling or binding of either yarn is experienced in tube 31 and the combined yarn may be delivered through eyelets or other guides to the next station in a textile manufacturing operation, such as formation of yarn sheets in a tufting operation.

It will be apparent that the invention is not limited to the specific details set forth above for purposes of illustration, and that various other embodiments and modifications are equivalent for the stated and illustrated functions without departing from the spirit and scope of the invention.

I claim:

1. In a device for combining a first yarn and a second yarn, the combination of:

a yarn holder adapted to hold first yarn wound thereon, said yarn holder having an axial passage for travel therethrough of a second yarn delivered from a yarn package spaced apart from said yarn holder;

guide means at the exit end of said yarn holder for guiding said first yarn to engagement with said second yarn whereby said first yarn is wrapped about and carried by said second yarn as said first yarn unwinds from said yarn holder; and support means supporting said yarn holder, said support means being adapted to pivot with said yarn holder about said guide means whereby said yarn holder aligns itself with the angle of delivery of said second yarn to said yarn holder.

2. A device as in claim 1 including guide means at the entry end of said yarn holder for guiding said second yarn to said entry end.

3. A device as in claim 1 wherein said support means comprises a wire having an end portion defining a mandrel for said yarn holder.

4. A device as in claim 3 wherein said mandrel is formed as a U-shape bend in said wire, said bend being adapted for an interference fit with the interior of said yarn holder.

5. A device as in claim 4 wherein a portion of said wire is formed as an eyelet for guiding yarn to the entry end of said yarn holder.

6. A device as in claim 4 wherein the end of said wire adjacent said U-shaped bend is bent at an angle to thereby operate as a stop for said yarn holder.

7. A device as in claim 1 wherein said yarn holder is tubular.

8. A device as in claim 1 wherein said yarn holder is a cone.

9. A device as in claim 1 including edge guide means at said exit end for preventing contact of said first yarn with said exit end.

10. A method of combining a first yarn and a second yarn supplied from spaced apart first and second yarn packages respectively, utilizing a device comprising the combination of a yarn holder and said first yarn wound thereon, said yarn holder having an axial passage for travel therethrough of said second yarn, guide means at the exit end of said yarn holder for guiding said first yarn to engagement with said second yarn, and support means supporting said yarn holder, said support means being adapted to pivot with said yarn holder about said guide means whereby said yarn holder aligns itself with the angle of delivery of said second yarn to said yarn holder; said method comprising continuously passing said second yarn through said yarn holder and said guide means, engaging said first yarn with said second yarn between the exit of said yarn holder and said guide means, whereby said first yarn is wrapped about and is carried by said second yarn as said first yarn unwinds from said yarn holder.

* * * * *